US009454861B2

(12) United States Patent
Mimura

(10) Patent No.: US 9,454,861 B2
(45) Date of Patent: Sep. 27, 2016

(54) REMOTE CONTROL SYSTEM

(71) Applicant: KABUSHIKI KAISHA TOKAI RIKA DENKI SEISAKUSHO, Aichi (JP)

(72) Inventor: Hironori Mimura, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 193 days.

(21) Appl. No.: 14/255,209

(22) Filed: Apr. 17, 2014

(65) Prior Publication Data

US 2014/0313011 A1 Oct. 23, 2014

(30) Foreign Application Priority Data

Apr. 23, 2013 (JP) ..... 2013-090578

(51) Int. Cl.
*G07C 9/00* (2006.01)

(52) U.S. Cl.
CPC . *G07C 9/00309* (2013.01); *G07C 2009/00793* (2013.01); *G07C 2209/62* (2013.01)

(58) Field of Classification Search
None
See application file for complete search history.

(56) References Cited

U.S. PATENT DOCUMENTS 6,542,071 B1 * 4/2003 Ohtsubo ..... B60R 25/2036 340/10.1
7,375,440 B2 * 5/2008 Suyama ..... B60R 25/00 307/10.2
8,627,433 B2 * 1/2014 Conner ..... H04W 12/06 713/168
8,688,325 B2 * 4/2014 Wolf ..... B60R 25/2045 348/154
2006/0244312 A1 * 11/2006 Ogino ..... B60R 25/257 307/9.1
2009/0072992 A1 3/2009 Yun
2009/0085720 A1 * 4/2009 Kurpinski ..... B60R 25/246 340/5.64
2010/0052931 A1 * 3/2010 Kolpasky ..... B60R 25/00 340/670
2011/0257817 A1 * 10/2011 Tieman ..... B60R 25/24 701/2
2013/0309964 A1 * 11/2013 Hall ..... H04B 5/00 455/41.1
2014/0051364 A1 * 2/2014 Simons ..... H04W 52/0229 455/68
2014/0232322 A1 * 8/2014 Kracker ..... H02J 7/0054 320/103
2014/0285319 A1 * 9/2014 Khan ..... G07C 9/00309 340/5.61
2015/0279131 A1 * 10/2015 Nespolo ..... G07C 9/00182 340/5.72
2015/0309767 A1 * 10/2015 Osoinach ..... G06F 3/165 340/4.42

FOREIGN PATENT DOCUMENTS

JP 09-303026 11/1997
JP 2004-236034 8/2004
JP 2008-028584 2/2008
JP 2012-149474 8/2012

OTHER PUBLICATIONS

Office Action issued by Japan patent office in Japan Patent Application No. 2013-090578, dated Aug. 16, 2016, and an English translation thereof.

* cited by examiner

*Primary Examiner* — Benjamin C Lee
*Assistant Examiner* — Chico A Foxx
(74) *Attorney, Agent, or Firm* — Greenblum & Bernstein, P.L.C.

(57) ABSTRACT

A remote control system includes a portable device and a security device. The portable device includes a motion sensor. The security device is configured to communicate with the portable device through wireless signals to control a vehicle in accordance with an action request motion detected by the motion sensor. The motion sensor is operated in an ON mode, which enables detection of an action request motion, and an OFF mode, which disables detection of the operation request motion. The security device controls the operation mode of the motion sensor in accordance with the condition of a vehicle.

13 Claims, 4 Drawing Sheets

REMOTE CONTROL SYSTEM

CROSS-REFERENCE TO RELATED APPLICATIONS

This application is based upon and claims the benefit of priority from prior Japanese Patent Application No. 2013-090578, filed on Apr. 23, 2013, the entire contents of which are incorporated herein by reference.

BACKGROUND

The present disclosure relates to a remote control system including a motion sensor that detects the motion of a user.

Japanese Laid-Open Patent Publication No. 9-303026 describes a remote control system that detects three-dimensional movement of a portable device with an acceleration sensor to control the operation of an on-board device distanced from a user in accordance with the type of the detected movement. For example, when a user produces an S-shaped motion with the portable device, the remote control system starts the engine.

SUMMARY

The inventor of the present disclosure has proposed a remote control system of a reference example that validates a signal output from an acceleration sensor of the portable device only when a push button switch of the portable device is pushed. Thus, the motion of the portable device is detected when the push button switch is pushed. In this case, the acceleration sensor is always activated even when the push button switch is not pushed. This increases the current consumption of the portable device.

It is an object of the present disclosure to provide a remote control system that allows for reduction in the current consumed by the portable device.

One aspect of the present disclosure is a remote control system used by a user to remotely control a control subject. The remote control system includes a portable device and a controller. The portable device includes a motion sensor that detects an action request motion produced by the user. The controller is configured to communicate with the portable device through a wireless signal to control the control subject in correspondence with the action request motion detected by the motion sensor. The motion sensor is set in operation modes including an ON mode that enables detection of the action request motion and an OFF mode that disables detection of the action request motion. The controller is configured to control the operation mode of the motion sensor in accordance with the condition of the control subject.

According to an embodiment, a remote control system that remotely controls a vehicle is provided. The remote control system includes a portable device and a security device. The portable device includes a memory that stores a portable device ID, a motion sensor that detects at least one action request motion, and a communication circuit that transmits a remote control signal corresponding to a detected action request motion. The security device is installed in the vehicle and is configured to communicate with the portable device. The security device includes a transmission circuit that transmits a wireless signal used to verify the portable device ID, and a verification ECU that adds, to the wireless signal, an ON command that sets the motion sensor in an ON mode or an OFF command that sets the motion sensor in an OFF mode in accordance with a monitoring result of the condition of the vehicle. The portable device includes a microcomputer that sets the motion sensor in the ON mode in response to the ON command in the wireless signal and sets the motion sensor in the OFF mode in response to the OFF command in the wireless signal.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF EMBODIMENT

One embodiment of a remote control system will now be described.

Figure 1:
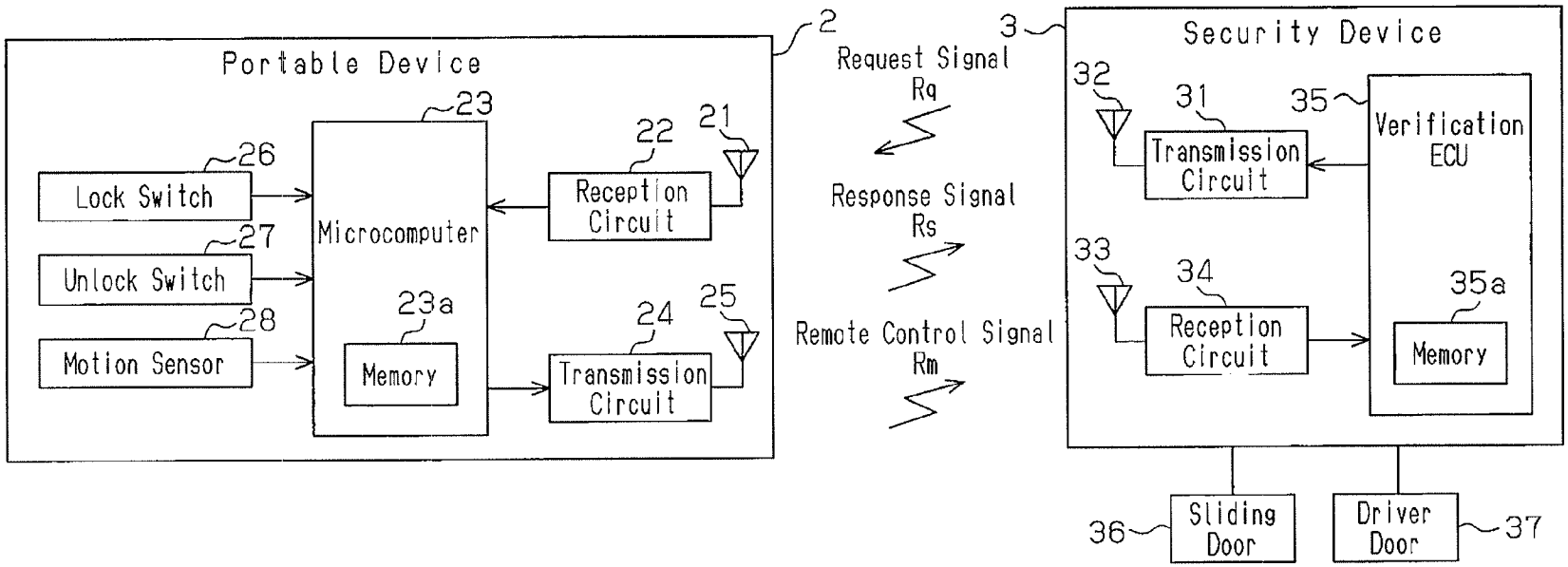
FIG. 1 is a block diagram of a remote control system.

As shown in FIG. 1, the remote control system 1 includes a portable device 2 and a security device 3. The portable device 2 may be a vehicle key carried by a user. The security device 3 is installed in, for example, a vehicle. In a preferred example, the portable device 2 and the security device 3 performs bidirectional wireless communication and/or unidirectional wireless communication, which is initiated with the transmission of a signal from the portable device 2.

The portable device 2 includes a reception antenna 21, a reception circuit 22, a microcomputer 23, a transmission circuit 24, a transmission antenna 25, a lock switch 26, an unlock switch 27, and a motion sensor 28.

The microcomputer 23 receives an ID request signal Rq from the security device 3 with the reception antenna 21 and the reception circuit 22.

The microcomputer 23 includes a non-volatile memory 23*a*. The memory 23*a* stores an ID unique to the portable device 2. When the microcomputer 23 receives the ID request signal Rq, the microcomputer 23 generates a response signal Rs, which includes the ID, and transmits the response signal Rs via the transmission circuit 24 and the transmission antenna 25. The response signal Rs is, for example, a wireless radio wave signal carried on the UHF band.

The lock switch 26 is, for example, a push button switch. The lock switch 26 provides the microcomputer 23 with a detection signal when operated by a user. When the microcomputer 23 receives a detection signal from the lock switch 26, the microcomputer 23 generates a remote control signal Rm, which includes the ID and an operation code (or lock command) that requests for the vehicle doors to be locked. The microcomputer 23 then transmits the remote control signal Rm via the transmission circuit 24 and the transmission antenna 25. The remote control signal Rm is, for example, a wireless radio wave signal carried on the UHF band.

The unlock switch 27 is, for example, a push button switch. The unlock switch 27 provides the microcomputer 23 with a detection signal when operated by a user. When the microcomputer 23 receives a detection signal from the unlock switch 27, the microcomputer 23 generates a remote control signal Rm, which includes the ID and an operation code (or unlock command) that requests for the vehicle doors to be unlocked. The microcomputer 23 then transmits the remote control signal Rm via the transmission circuit 24 and the transmission antenna 25. The remote control signal Rm is, for example, a wireless radio wave signal carried on the UHF band.

The motion sensor 28 is incorporated in the portable device 2 to detect a motion produced by the user. The motion sensor 28 is used in operation modes including an ON mode, which enables the detection of a motion produced by the user, and an OFF mode, which disables the detection of a motion produced by the user. When the motion sensor 28 is in the ON mode and detects a motion produced by the user, the motion sensor 28 provides the microcomputer 23 with a detection signal corresponding to the detected motion of the user. In one example, the motion sensor 28 detects the acceleration applied to the portable device 2 and provides the microcomputer 23 with a detection signal corresponding to the detected acceleration. The microcomputer 23 recognizes the motion produced by the user based on the detection signal of the motion sensor 28. Then, the microcomputer 23 generates a remote control signal Rm including the ID and an operation code (command), which corresponds to the type of the motion, that is, the vehicle action requested by the user. The microcomputer 23 transmits the remote control signal Rm via the transmission circuit 24 and the transmission antenna 25. For example, a swinging motion of the portable device 2 corresponds to the opening and/or closing of the sliding door 36 is one example of an operation request motion. In the illustrated example, the sliding door 36 is configured to move in a first direction (such as an open direction) in response to a moving command and reverse movement during movement in the first direction in response to a following moving command to move in a second direction (such as a close direction), which is opposite to the first direction. The sliding door 36 is one example of a shutting body, a movable body, and a first control subject. The vehicle is one example of a control subject.

The security device 3 includes a transmission circuit 31, a transmission antenna 32, a reception antenna 33, a reception circuit 34, and a verification electronic control unit (ECU) 35. The verification ECU 35 transmits an ID request signal Rq from the transmission circuit 31 and the transmission antenna 32. The ID request signal Rq may be received, for example, within a limited communication area near the vehicle.

The verification ECU 35 receives the response signal Rs and the remote control signal Rm from the portable device 2 with the reception antenna 33 and the reception circuit 34.

The verification ECU 35 includes a non-volatile memory 35*a*. The memory 35*a* stores the ID of the authentic portable device 2 (also referred to as the reference ID) registered in advance to the vehicle or the security device 3. The verification ECU 35 receives the response signal Rs or the remote control signal Rm with the reception circuit 34 and verifies the ID included in the received signal with the reference ID. When the two IDs are in conformance, the verification ECU 35 permits the execution of the vehicle action requested by the portable device 2 (locking and unlocking of vehicle doors, starting of engine, opening of sliding door 36, and closing of sliding door 36).

The verification ECU 35 is configured to control the operation mode of the motion sensor 28 in accordance with the vehicle condition. In the preferred example, the verification ECU 35 controls or manages the operation mode of the motion sensor 28 in accordance with the vehicle condition by adding, to the ID request signal, an ON command, which sets the motion sensor 28 in the ON mode, and/or an OFF command, which sets the motion sensor 28 in the OFF mode. The ON command may include an ON duration time command that designates the ON duration time of the motion sensor 28. In this case, the verification ECU 35 adds, to the ID request signal Rq, an ON command configured to keep the motion sensor 28 in the ON mode for a period corresponding to the ON duration time.

When the microcomputer 23 of the portable device 2 receives an ID request signal Rq, the microcomputer 23 analyzes the ID request signal Rq. When the ID request signal Rq includes an ON command, the microcomputer 23 sets the motion sensor 28 in the ON mode for a period corresponding to the ON duration time. When the ID request signal Rq includes an OFF command, the microcomputer 23 forcibly sets the motion sensor 28 in the OFF mode even when the ON duration time of a received ON command has not yet elapsed. The microcomputer 23 maintains the motion sensor 28 in the OFF mode until the microcomputer 23 receives the next ON command.

Regardless of whether the motion sensor 28 is in the ON mode or the OFF mode, the portable device 2 normally performs a sequence of ID verification operations from the reception of an ID request signal Rq to the transmission of the response signal Rs.

The operation of the remote control system 1 will now be described.

Figure 2:
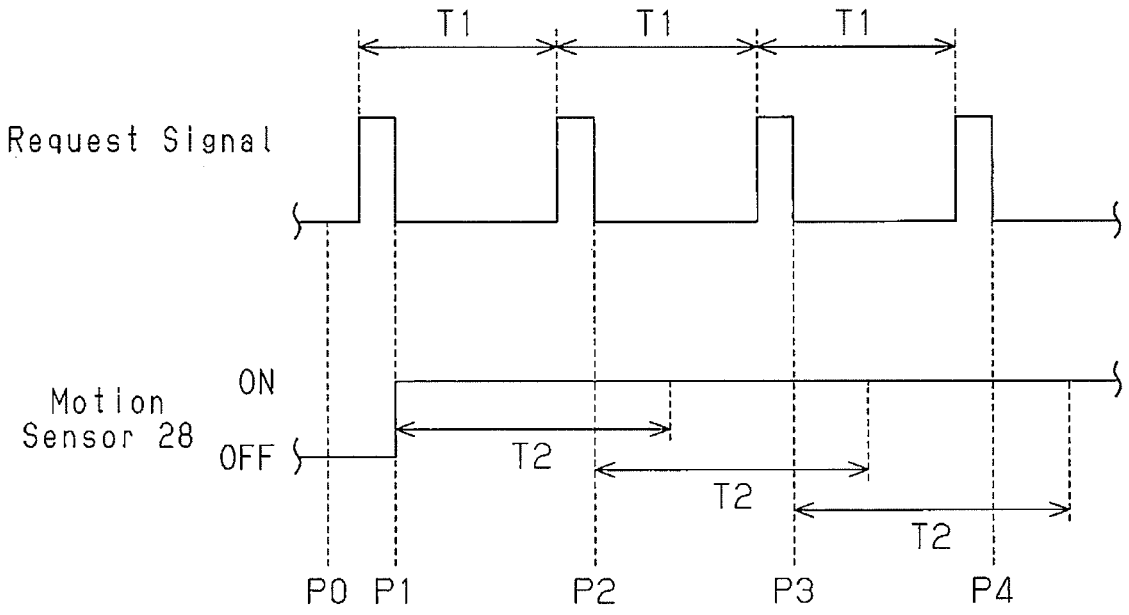
FIG. 2 is a time chart illustrating an ID request signal and operation modes of a motion sensor.

Referring to FIG. 2, when the vehicle doors, including the sliding door 36, are all locked, an ID request signal Rq is intermittently transmitted in a transmission cycle T1. In order to set the motion sensor 28 in the ON mode to monitor motions produced by the user, the verification ECU 35 adds an ON command to the ID request signal. The ON command includes an ON duration time command that designates an ON duration time T2, which is longer than the transmission cycle T1 of the ID request signal Rq. In the example of FIG. 2, at time P0, the portable device 2 enters a communication area, in which the ID request signal Rq is receivable. Then, at time P1, the portable device 2 completes the analysis of the ID request signal Rq. The motion sensor 28 remains in the ON mode over the ON duration time T2 from time P1. The ON duration time T2 is longer than the transmission cycle T1. Thus, at time P2, the analysis of the next ID request signal Rq has been completed, and the motion sensor 28 remains in the ON mode over the ON duration time T2 from time P2. In the same manner, at time P3, the analysis of the next ID request signal Rq has been completed, and the motion sensor 28 remains in the ON mode over the ON duration time T2 from time P2. Accordingly, the motion sensor 28 is continuously maintained in the ON mode by adding the ON command, which includes the ON duration time T2 that is longer than the transmission cycle T1 of the request signal Rq, to the ID request signal Rq. If the user produces a swinging motion (action request motion) when the motion sensor 28 is in the ON mode, the sliding door 36 opens or closes in accordance with the motion produced by the user.

Figure 3:
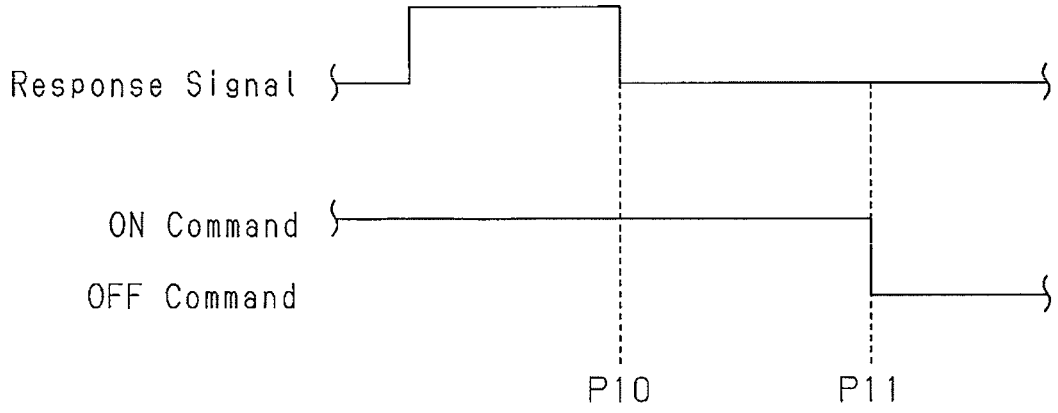
FIG. 3 is a time chart illustrating when a driver door opens and when an OFF command is added.

Referring to FIG. 3, at time P10, the analysis of a response signal Rs is completed, and the unlocking of the vehicle doors is completed. Then, at time P11, when the verification ECU 35 detects that a driver door 37 has been opened, the verification ECU 35 adds an OFF command to an ID request signal Rq. In accordance with the OFF command in the ID request signal Rq, the microcomputer 23 of the portable device 2 sets the motion sensor 28 in the OFF mode. In this example, from the fact that the driver door 37 has been opened at time P11, it may be assumed that the user who opened the driver door 37 is likely to be able to manually open the sliding door 36 without having to produce a swinging motion. Thus, in this case, the motion sensor 28, which is used to detect a swinging motion corresponding to the opening of the sliding door 36, is set in the OFF mode. This increases the opportunities in which the motion sensor 28 is in the OFF mode and reduces the current consumption of the portable device 2. The driver door 37 is one example of the second control subject 37.

Figure 4:
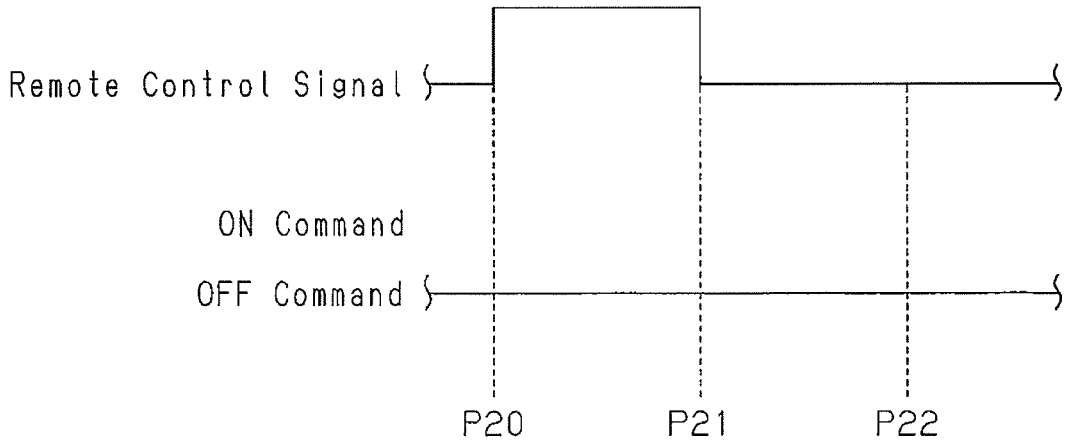
FIG. 4 is a time chart illustrating when an unlock switch is operated and when an OFF command is added in response to a remote control signal.

A case when the portable device 2 is outside the communication area, in which the ID request signal Rq is receivable, will now be described. Referring to FIG. 4, at time P20, the unlock switch 27 of the portable device 2 is operated. At time P21, the verification ECU 35 completes the analysis of the remote control signal Rm. Then, at time P22, the OFF command still remains added to the ID request signal Rq even if the portable device 2 enters the communication area, in which the ID request signal Rq is receivable. From the fact that the unlock switch 27 has been operated, it may be assumed that the user who manually operated the unlock switch 27 is likely to be able to manually open the sliding door 36 without having to produce a swinging motion. Thus, in this case, the motion sensor 28, which is used to detect a swinging motion corresponding to the opening of the sliding door 36, remains in the OFF mode. This increases the opportunities in which the motion sensor 28 is in the OFF mode and reduces the current consumption of the portable device 2 without affecting convenience.

Figure 5:
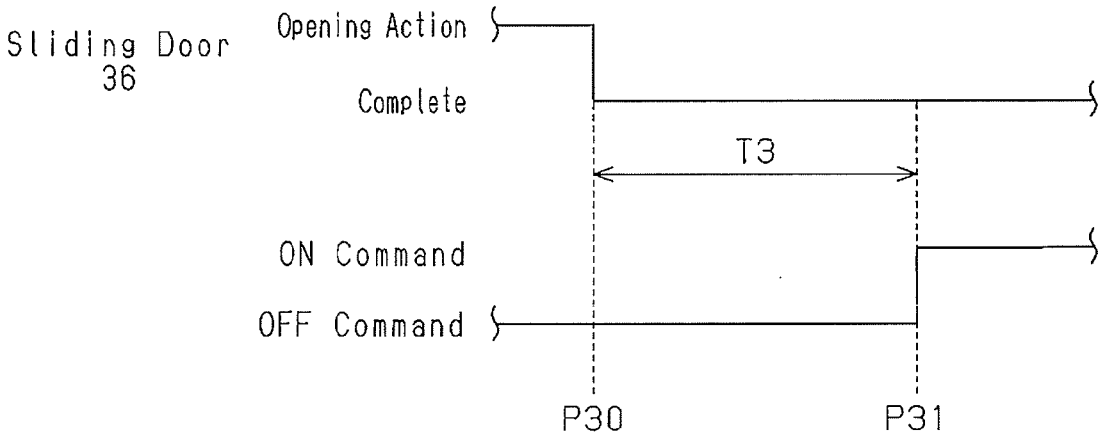
FIG. 5 is a time chart illustrating an ON command added after a delay time elapses from when a closing action of a sliding door has been completed.

Referring to FIG. 5, at time P30, the verification ECU 35 detects that the sliding door 36 has completed an opening action. At time P31, which is when a predetermined delay time T3 elapses from time P30, the verification ECU 35 adds an ON command to the ID request signal Rq. In accordance with the ON command included in the ID request signal Rq, the microcomputer 23 of the portable device 2 sets the motion sensor 28 in the ON mode. In this example, after the sliding door 36 completely opens, the user removes cargo from the vehicle during the delay time T3, and the two hands of the user are thus not free. Under this situation, after the delay time T3 elapses, the verification ECU 35 includes an ON command in the ID request signal Rq to enable the detection of a motion produced by the user and corresponding to a closing action of the sliding door 36. This allows the user to close the sliding door 36 by swinging the portable device 2 even when the two hands of the user are carrying cargo and thus not free. The delay time T3 may be set taking into consideration the time needed to remove cargo from the vehicle. When a short delay time T3 is set, the detection of an action request motion produced by the user is ensured. A long delay time T3 would, however, be preferable for reducing current consumption.

Figure 6:
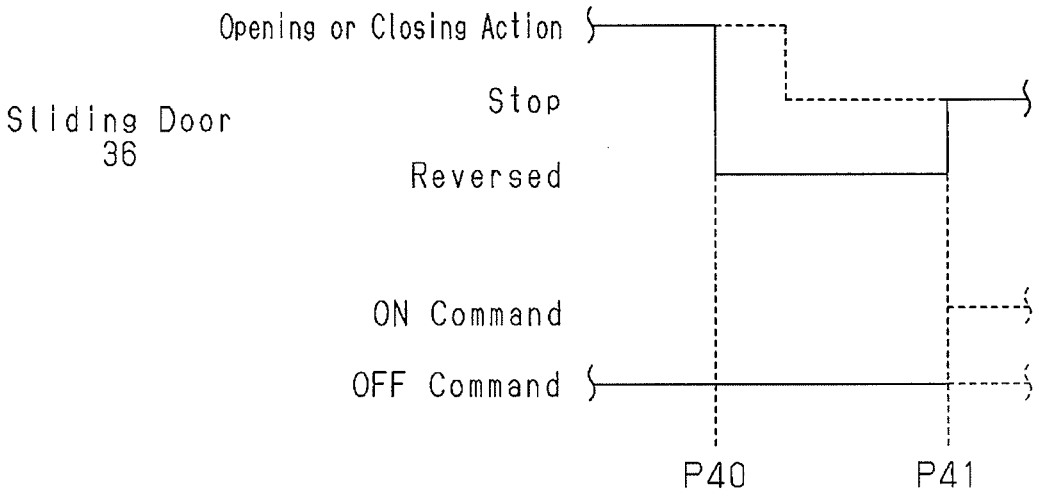
FIG. 6 is a time chart illustrating an OFF command that is continuously added until a reversing action of the sliding door has been completed.

In the example of FIG. 6, at time P40, which is during an opening or closing action of the sliding door 36, when a handle of the sliding door 36 is touched, the sliding door 36 reverses the moving direction. In this case, at time P41, the verification ECU 35 adds an OFF signal to the ID request signal Rq until the reversed action is completed. In the portable device 2 that receives the ID request signal Rq, when the reversing action of the sliding door 36 is completed, the motion sensor 28 is set in the OFF mode. In the portable device 2 that receives the ID request signal Rq, the motion sensor 28 remains in the OFF mode until the reversing action of the sliding door 36 is completed. After time P41 when the reversing action is completed, an ON command or an OFF command is selectively added to the ID requests signal Rq in accordance with the vehicle condition.

The unlock switch 27 is one example of a manual operation unit, and the security device 3 or the verification ECU 35 is one example of a controller.

The present embodiment has the advantages described below.

(1) The security device 3 is configured to control the operation mode of the motion sensor 28 in the portable device 2 in accordance with the vehicle condition. The security device 3 (or the verification ECU 35) may set the motion sensor 28 in the ON mode only when the detection of an action request motion is necessary in accordance with, for example, the vehicle condition. This allows for reduction in the current consumption of the portable device 2.

(2) The security device 3 may add an ON command and/or an OFF command to the ID request signal Rq, which is used in wireless communication that is performed for ID verification of the portable device 2, to control the operation mode of the motion sensor 28.

(3) The motion sensor 28 is set in the ON mode only when the vehicle is in a situation permitting the sliding door 36 to open or close in correspondence with an action request motion. When the vehicle is not in a situation permitting the sliding door 36 to open or close in correspondence with an action request motion, the motion sensor 28 is in the OFF mode. Accordingly, the operation mode of the motion sensor 28 may be controlled in a suitable manner.

(4) The motion sensor 28 remains in the ON mode during the ON duration time designated by the ON command in the ID request signal Rq. This allows for the operation mode of the motion sensor 28 to be controlled in a suitable manner.

(5) The security device 3 is configured to transmit an ID request signal Rq in the transmission cycle T1. The verification ECU 35 adds, to the ID request signal, an ON command that designates a longer ON duration time T2 than the transmission cycle T1. In this case, the validity (ON duration time) of the ON command in the preceding ID request signal Rq continues until after the following ID request signal is transmitted. Accordingly, under a situation in which an action request motion produced by the user needs to be monitored in a continuous and seamless manner, the motion sensor 28 remains in the ON mode.

(6) When the driver door 37 opens, the verification ECU 35 sets the motion sensor 28 in the OFF mode. For example, from the fact that the driver door 37 has been opened, it may be assumed that the user who opened the driver door 37 is likely to be able to manually open the sliding door 36 without having to produce a swinging motion. Thus, in this case, the motion sensor 28, which is used to detect a swinging motion corresponding to the opening of the sliding door 36, is set in the OFF mode. This increases the opportunities in which the motion sensor 28 is in the OFF mode and reduces the current consumption of the portable device 2 without affecting the convenience.

(7) When the verification ECU 35 obtains a remote control signal Rm indicating that the unlock switch 27 of the portable device 2 has been operated, the verification ECU 35 sets the motion sensor 28 in the OFF mode. From the fact that the unlock switch 27 of the portable device 2 has been operated, it may be assumed that the user who operated the unlock switch 27 is likely to be able to manually open the sliding door 36 without having to produce a swinging motion. Thus, in this case, the motion sensor 28, which is used to detect a swinging motion corresponding to the opening of the sliding door 36, remains in the OFF mode. This increases the opportunities in which the motion sensor 28 is in the OFF mode and reduces the current consumption of the portable device 2 without affecting convenience.

(8) When an opening action of the sliding door 36 is completed, the verification ECU 35 sets the motion sensor 28 in the ON mode. For example, when the sliding doors 36 opens and cargo is removed from the vehicle, the user may be carrying the cargo and the two hands of the user may thus not be free. Even in such a case, the user may perform an action request motion to automatically close the sliding door 36. Accordingly, this improves convenience.

(9) After the delay time T3 elapses from when an opening action of the sliding door 36 is completed, the verification ECU 35 sets the motion sensor 28 in the ON mode. For example, the motion sensor 28 may be kept in the OFF mode until the delay time T3 elapses, which may be the time used to remove cargo from the vehicle. This reduces current consumption of the portable device 2.

(10) When the action of the sliding door 36 is reversed, the verification ECU 35 keeps the motion sensor 28 in the OFF mode until the reversed action is completed. An action request motion is not detected during the period until when the reversed action of the sliding door 36 is completed. This prevents the occurrence of an erroneous operation of the sliding door 36 resulting from an erroneous operation of the portable device 2 during a reversed action. Further, since the motion sensor 28 is in OFF mode, current consumption of the portable device 2 may be reduced.

It should be apparent to those skilled in the art that the present invention may be embodied in many other specific forms without departing from the spirit or scope of the invention. Particularly, it should be understood that the present invention may be embodied in the following forms.

The security device 3 may be configured to transmit a polling signal, which may be a radio wave signal on the LF band, when the security device 3 receives a response signal Rs for an ID request signal Rq. In this case, the security device 3 may add an ON command and/or an OFF command to the polling signal. For example, an ON command added to a polling signal may designate an ON duration time of five seconds. Typically, about five seconds is needed from when the portable device 2 enters a communication area in which the polling signal is receivable to when the portable device 2 enters the vehicle compartment. This allows for the monitoring of action request motion of the portable device 2. When the driver door 37 opens before five seconds elapses, the security device 3 may add an OFF signal to the security device 3.

When the transmission antenna 32 includes an exterior antenna that transmits an ID request signal Rq outside the vehicle and an interior antenna that transmits an ID request signal Rq inside the vehicle, the location of the portable device 2 outside or inside the vehicle may be specified by analyzing the source of the ID request signal Rq to which a response signal Rs is generated in response. In this case, when the portable device 2 is located in the vehicle, the motion sensor 28 may be in the OFF mode. The portable device 2 that is located in the vehicle would not be used to produce a motion and there would be no problem if the motion sensor 28 remains in the OFF mode. The portable device 2 may be used together with another portable device 2. When the other portable device 2 is located outside the vehicle, the motion sensor 28 is set in the OFF mode when the ON duration period elapses. Subsequently, when the other portable device 2 enters a communication area in which the ID request signal Rq is receivable, the motion sensor 28 of the other portable device 2 is set in the ON mode. When the other portable device 2 enters the vehicle compartment, the motion sensor 28 of the other portable device 2 is set in the OFF mode.

Figure 7:
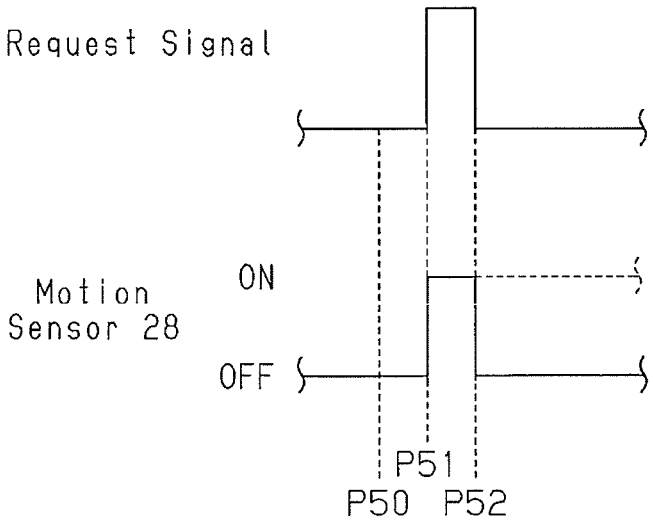
FIG. 7 is a time chart illustrating the operation of the motion sensor that is synchronized with the rising and falling edges of an ID request signal.

Referring to FIG. 7, the rising edge of an ID request signal Rq may function as an ON command. In this case, it is preferable that an OFF command be added to the ID request signal. For example, at time P50, the portable device 2 enters the communication area in which the ID request signal Rq is receivable. Then, at time P51, when the portable device 2 detects a rising edge of the ID request signal Rq, the motion sensor 28 of the portable device 2 is set in the ON mode. At time P52, the analysis of the ID request signal Rq including an OFF command is completed and the motion sensor 28 is forcibly set in the OFF mode. When the ID request signal Rq does not include an OFF command, the motion sensor 28 remains in the ON mode.

The action request motion and the corresponding control subject discussed above may be changed. For example, the action request motion is not limited to an opening or closing action of the sliding door 36 and may correspond to an opening action of the trunk, a function that monitors the movement of the portable device 2 while preventing unauthorized actions using a relay, a function that locates the portable device 2 while analyzing a response signal and being hospitable to the user of the portable device, an engine starting permission, a change in the ON duration time, or the like. The control subject is not limited to a vehicle and may be a shutting body such as a door or a shutter for a building.

The motion sensor 28 is not limited to an acceleration sensor and may be an angular velocity sensor that detects the angular velocity applied to the portable device 2. The type and number of action request motions detected by the motion sensor 28 may be changed.

Embodiments within the scope of the present invention also include computer-readable media for carrying or having computer-executable instructions or data structures stored thereon. Computer-executable instructions comprise, for example, instructions and data which cause a general purpose computer, special purpose computer, or special purpose processing device to perform a certain function or group of functions.

The above description is intended to be illustrative, and not restrictive. For example, the above-described examples (or one or more aspects thereof) may be used in combination with each other. Other embodiments can be used, such as by one of ordinary skill in the art upon reviewing the above description. Also, in the above description, various features may be grouped together to streamline the disclosure. This should not be interpreted as intending that an unclaimed disclosed feature is essential to any claim. Rather, inventive subject matter may lie in less than all features of a particular disclosed embodiment. Thus, the claims are hereby incorporated into the description, with each claim standing on its own as a separate embodiment. The scope of the invention should be determined with reference to the appended claims, along with the full scope of equivalents to which such claims are entitled.

The invention claimed is:

1. A remote control system used by a user to remotely control a sliding shutting body of a vehicle that opens and closes to allow access to the vehicle, the remote control system comprising:

a portable device including a motion sensor that detects an action request motion produced by the user; and a controller, located at the vehicle, configured to communicate with the portable device through a wireless signal to control the sliding shutting body in correspondence with the action request motion detected by the motion sensor to respectively open or close the sliding shutting body, wherein the motion sensor is set in operation modes, the operation modes including an ON mode that enables detection of the action request motion and an OFF mode that disables detection of the action request motion, and the controller is configured to selectively set the motion sensor in the OFF mode in accordance with a determined condition of the sliding shutting body;

wherein the motion sensor is configured to cause transmission by the portable device, through wireless communication to the controller, of a remote control signal that automatically closes the sliding shutting body when the motion sensor detects that the action request motion indicates a closing action request of the sliding shutting body, and wherein when the controller determines that the condition of the sliding shutting body is an opening action of the sliding shutting body prior to the completion of the automatic closing of the sliding shutting body, the controller is configured to set the motion sensor in the OFF mode, and subsequently set the motion sensor in the ON mode when the opening action of the sliding shutting body is completed.

2. The remote control system according to claim 1, wherein the portable device is configured to receive an ID request signal transmitted from the controller, and the controller is configured to control the operation mode of the motion sensor by adding, to the ID request signal, at least one of an ON command that sets the motion sensor in the ON mode and an OFF command that selectively sets the motion sensor in the OFF mode.

3. The remote control system according to claim 1, wherein the controller is configured to set the motion sensor in the ON mode at least when an action of the sliding shutting body corresponding to the action request motion is permitted, or the controller is configured to selectively set the motion sensor in the OFF mode when the action of the sliding shutting body corresponding to the action request motion is restricted.

4. The remote control system according to claim 2, wherein the controller is configured to add the ON command that designates an ON duration time of the motion sensor to the ID request signal.

5. The remote control system according to claim 2, wherein the controller is configured to transmit the ID request signal in a transmission cycle, and the controller is configured to add, to the ID request signal, the ON command designating the ON duration time that is longer than the transmission cycle of the ID request signal.

6. The remote control system according to claim 1, wherein the allowed access to the vehicle includes the sliding shutting body and a driver shutting body, the controller is configured to perform an action corresponding to the action request motion with the sliding shutting body when the action request motion is detected, and the controller is further configured to selectively set the motion sensor in the OFF mode when the driver shutting body is operated.

7. The remote control system according to claim 1, wherein the portable device includes a manual switch;

the portable device is configured to transmit, through wireless communication, a remote control signal indicating that the manual switch has been manually operated; and the controller is configured to selectively set the motion sensor in the OFF mode when obtaining the remote control signal indicating that the manual switch has been manually operated.

8. The remote control system according to claim 1, wherein the controller is configured to set the motion sensor in the ON mode after a predetermined delay time elapses from the sliding shutting body completes the open action.

9. The remote control system according to claim 1, wherein the sliding shutting body is configured to perform a movement in a first direction, corresponding to an open door movement or a close to movement respectively, in response to a moving command indicative of the action request motion, and to respectively reverse movement during the movement in the first direction in response to a following moving command to move in a second direction, which is opposite to the first direction; and the controller is configured to selectively set the motion sensor in the OFF mode from when the sliding shutting body is reversed to when the reversed movement of the movable body is completed.

10. The remote control system according to claim 1, wherein the shutting body is a door.

11. A remote control system that remotely controls a vehicle, the remote control system comprising:

a portable device including a memory that stores a portable device ID, a motion sensor configured to detect action request motions, and a communication circuit that transmits a remote control signal corresponding to a detected one of the action request motions; and a security device installed in the vehicle and configured to communicate with the portable device, wherein the security device includes:

a transmission circuit that transmits a wireless signal used to verify the portable device ID, to the portable device, and a verification ECU that selectively adds, to the wireless signal, an ON command to set the motion sensor in an ON mode or an OFF command to selectively set the motion sensor in an OFF mode, in accordance with a monitoring result of opening/closing condition of a door of the vehicle, and the portable device includes a microcomputer that sets the motion sensor in the ON mode in response to receiving the ON command in the wireless signal and sets the motion sensor in the OFF mode in response to receiving the OFF command in the wireless signal, wherein the action request motions correspond to an automatic opening action command and an automatic closing operation command, respectively, for a sliding door of the vehicle when the motion sensor is in the ON mode, wherein when the verification ECU determines that the opening/closing condition of the sliding door is a reverse action of the automatic opening or closing action of the sliding door prior to the completion of the automatic opening or closing action respectively of the sliding door resulting from the corresponding action request motion and command, the verification ECU is configured to set the motion sensor in the OFF mode until the completion of the reverse action, through adding the OFF command to the wireless signal for reception by the portable device, and then subsequently set the motion sensor in the ON mode, and the verification ECU is further configured to set the motion sensor in the OFF mode through adding the OFF command to the wireless signal for reception by the portable device, responsive to the monitored opening/closing condition of a vehicle door being a driver door in an opening condition.

12. The remote control system according to claim 11, wherein the wireless signal is an ID request signal that requests for the portable device ID.

13. The remote control system according to claim 11, wherein the security device transmits an ID request signal that requests for the portable device ID, receives a response signal for the ID request signal, and then transmits a polling signal as the wireless signal; and the verification ECU is configured to add the ON command or the OFF command to the polling signal.

* * * * *